US007836735B2

(12) United States Patent
Liu

(10) Patent No.: US 7,836,735 B2
(45) Date of Patent: Nov. 23, 2010

(54) DRAWER LOCK SET

(75) Inventor: Tien-Kao Liu, Pingtung County (TW)

(73) Assignee: Federal Lock Co. Ltd., Pingtung County (TW)

( * ) Notice: Subject to any disclaimer, the term of this patent is extended or adjusted under 35 U.S.C. 154(b) by 149 days.

(21) Appl. No.: 12/318,615

(22) Filed: Jan. 2, 2009

(65) Prior Publication Data

US 2010/0170309 A1 Jul. 8, 2010

(51) Int. Cl.
*E05B 9/04* (2006.01)

(52) U.S. Cl. ..... 70/81; 70/86; 70/370; 70/374; 70/379 R; 70/379 A; 70/380; 70/451; 70/461; 70/462; 70/DIG. 42

(58) Field of Classification Search ..... 70/461, 70/462, DIG. 42, DIG. 62, 379 R, 379 A, 70/380, 77–81, 83, 85–88, 134, 370–374, 70/447–449, 451, 466, 381
See application file for complete search history.

(56) References Cited

U.S. PATENT DOCUMENTS 1,591,010 A * 7/1926 Best ..... 70/134
2,976,714 A * 3/1961 Hofgesang ..... 70/63
3,141,319 A * 7/1964 Schlage ..... 70/81
3,293,892 A * 12/1966 Falk ..... 70/493
3,304,755 A * 2/1967 Johnstone ..... 70/279.1
3,464,242 A * 9/1969 Torii ..... 70/134
3,815,390 A * 6/1974 Stoia ..... 70/134
3,928,991 A * 12/1975 Gaul et al. ..... 70/493
4,028,917 A * 6/1977 Schlage ..... 70/389
4,100,774 A * 7/1978 Solovieff et al. ..... 70/380
4,313,320 A * 2/1982 Best et al. ..... 70/134
4,563,885 A * 1/1986 Madden ..... 70/97
4,683,733 A * 8/1987 Marin ..... 70/134
4,926,670 A * 5/1990 Deforrest, Sr. ..... 70/374
5,551,263 A * 9/1996 Myers et al. ..... 70/86
5,737,950 A * 4/1998 Yun-Bin ..... 70/379 R
5,884,512 A * 3/1999 Wayne ..... 70/370
2007/0227210 A1* 10/2007 Martin ..... 70/466

* cited by examiner

*Primary Examiner*—Lloyd A Gall

(57) ABSTRACT

A drawer lock set includes a body with a tubular member and a block extends radially from an inner periphery of the tubular member. A cylinder and a core are received in the tubular member. The core includes a driving piece extending from a distal end thereof and is capable of driving a transmission member which is able to rotate a driving member. The driving member includes a protrusion which is slidably engaged with a groove defined in the dead bolt. The cylinder includes a first notch and a second notch in an outer periphery thereof and a 90-degree angular distance is defined between the first and second notches. The block is engaged with one of the first and second notches so as to set the position of the operational direction of the dead bolt with only one part replaced.

2 Claims, 11 Drawing Sheets

DRAWER LOCK SET

FIELD OF THE INVENTION

The present invention relates to a lock set, and more particularly, to a drawer lock set whose dead bolt can be operated in four different directions.

BACKGROUND OF THE INVENTION

A conventional drawer lock set includes a dead bolt which can be operated by using a key to lock or unlock the drawer. Generally, the dead bolt of the conventional drawer lock set can be operated vertically as shown in FIGS. 1 and 2, and operated horizontally as shown in FIGS. 3 and 4. Both of the two types of the conventional drawer lock sets includes a body 10/10' and a tubular member 101 extends from the body 10/10'. An elongate ridge 1011 and an elongate groove 1012 are located in the inner periphery of the tubular member 101. A cylinder 20 receives a core 30 therein and both of which are inserted into the tubular member 101. The cylinder 20 includes a passage 201 through which the pin frame 301 on the core 30 can slide therein. The cylinder 20 further includes an elongate recess 202 and a curved opening 203. The elongate ridge 1011 of the tubular member 101 is engaged with the elongate recess 202 of the cylinder 20, and the curved recess 202 of the cylinder 20 is engaged with the elongate groove 1012. The core 30 includes a driving piece 302 extending from a distal end thereof and the driving piece 302 is engaged with a hole 401 of a driving member 40 which is located to the body 10 and located opposite to the tubular member 101. A protrusion 402 extends from the driving member 40 and is movably engaged with a slot 501 defined in the dead bolt 50. Two pressing members 70 are located on two sides of the dead bolt 50. An end plate 60 is connected to the body 10/10' to retain and position the driving member 40, the dead bolt 50 and the pressing members 70. When the user uses a key (not shown) to rotate the core 40, the driving member 302 rotates the driving member 40, and the protrusion 402 pushes the dead bolt 50 to be extended out or retracted inward.

Further referring to FIG. 5, it is noted that the two types of the conventional drawer lock set almost have the same parts and structure, except for the direction that the cylinder 20, the body 10 and the dead bolt 50 are located. Most of the users are used to use the key to cooperate with an upright keyhole so that when the dead bolt 50 is operated in horizontal direction while the keyhole is maintained to be upright, the position of the elongate groove 1012 and the length of the tubular member 101 have to be changed. The manufacturers have to manufacture the two different bodies 10, 10' by two different molding units which is costly. Besides, the parts that have slightly differences are easily confused when assembling the lock sets.

Besides, because the core 30 includes the pin frame 301 which may have different sizes for different designs of the lock set, so that the length of the passage 201 of the cylinder 20 will be varied. Therefore, the manufacturers have to prepare two molding units for manufacturing the core 30 and the cylinder 20, this increases the manufacturing cost.

The present invention intends to provide a drawer lock set which can be used for the need of horizontal operation or vertically operation of the dead bolt with only one part replaced.

SUMMARY OF THE INVENTION

The present invention relates to a drawer lock set which comprises a body having a tubular member extending from a first side thereof and a block extends radially from an inner periphery of the tubular member. A cylinder is received in the tubular member and includes a first notch and a second notch defined in an outer periphery thereof. A 90-degree angular distance is defined between the first and second notches. The block is engaged with one of the first and second notches. A core is received in the cylinder and has a driving piece extending from a distal end thereof.

A transmission member is connected to a second side of the body and has a recess in which the driving piece is engaged. A first protrusion extends from a side of the transmission member and is slidably engaged with the curved slot defined in a driving member. A second protrusion extends from a second side of the driving member and is slidably engaged with a groove defined in a dead bolt.

By engaging the first or second notch of the cylinder with the block in the tubular member, the keyhole can be maintain upright and the dead bolt can be changed its operational direction.

The primary object of the present invention is to provide a drawer lock set wherein the direction that the dead bolt is operated can be easily transferred from one to another with only one part replaced.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
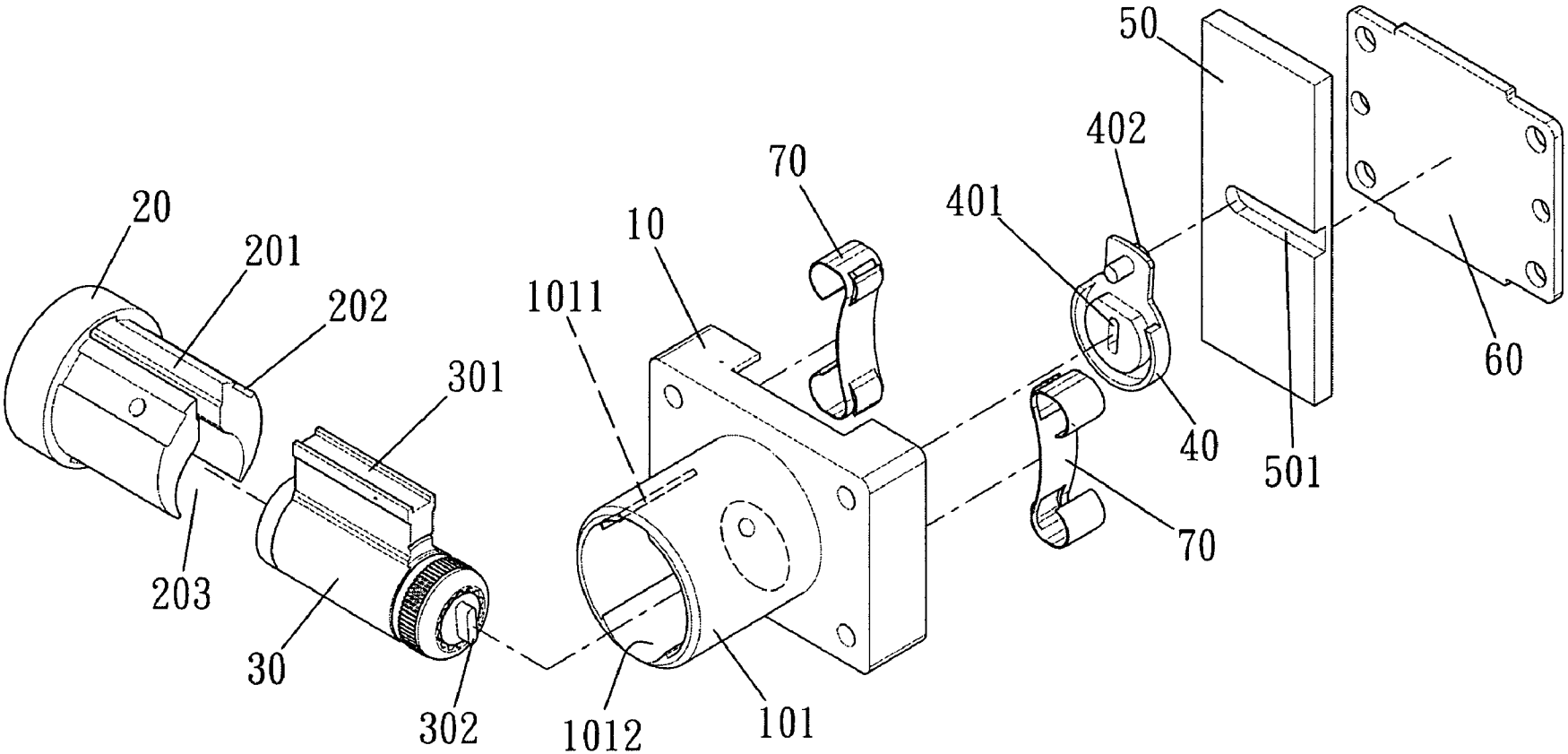
FIG. 1(PRIOR ART)
FIG. 1 is an exploded view to show a first conventional drawer lock set.
Figure 2:
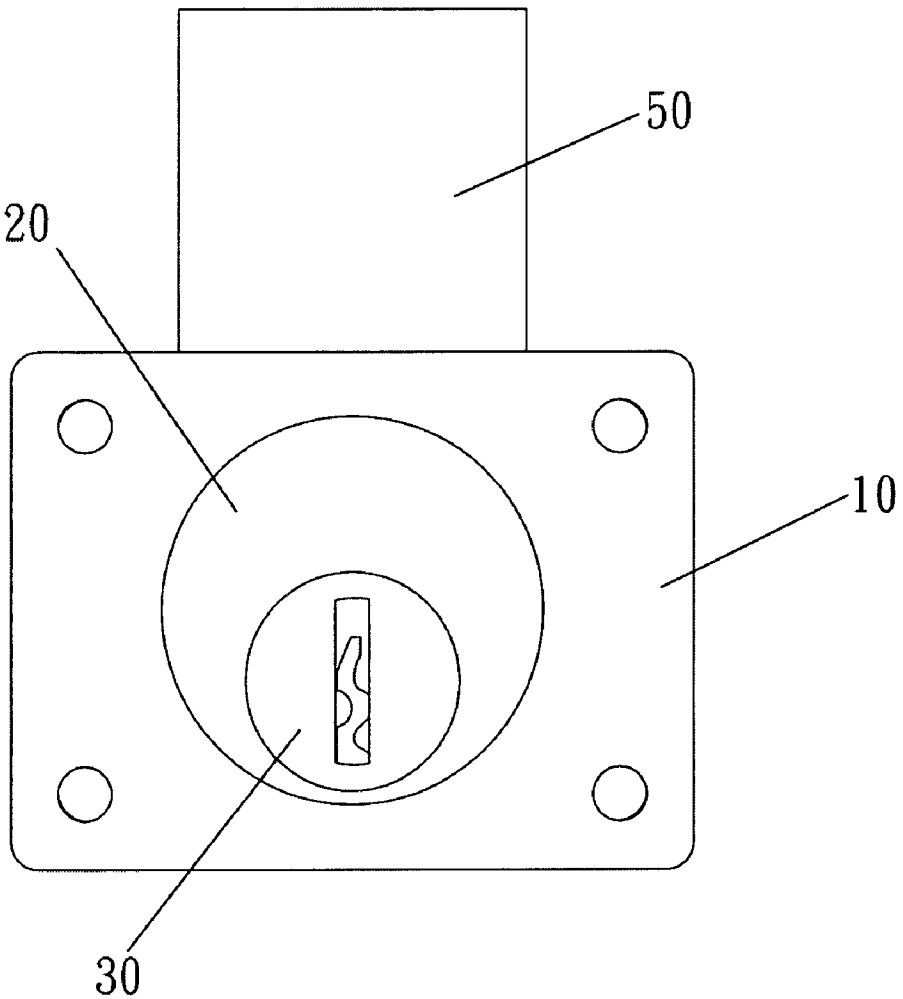
FIG. 2(PRIOR ART)
FIG. 2 shows that the dead bolt of the first conventional drawer lock set is operated in vertical direction.
Figure 3:
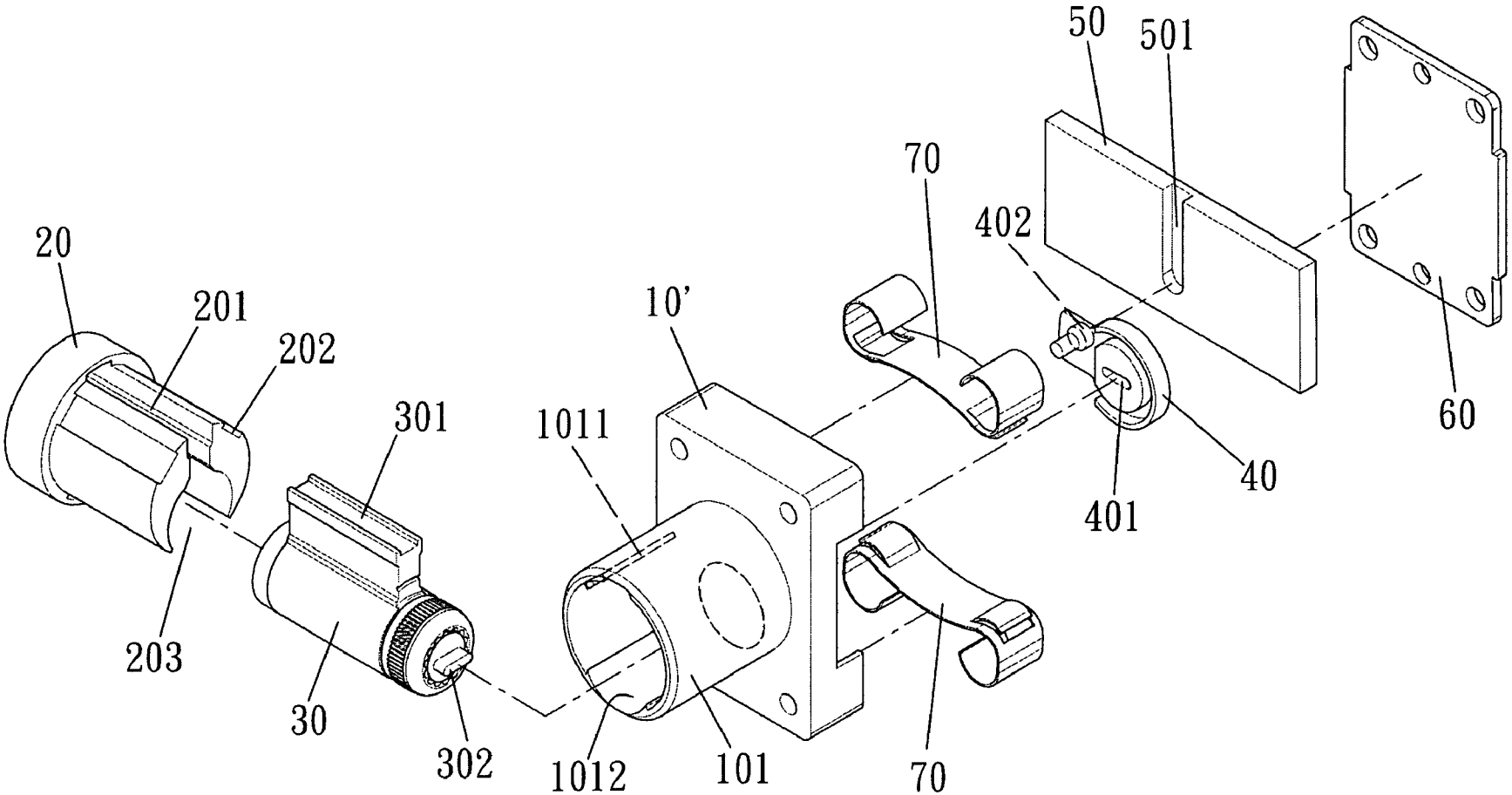
FIG. 3(PRIOR ART)
FIG. 3 is an exploded view to show a second conventional drawer lock set.
Figure 4:
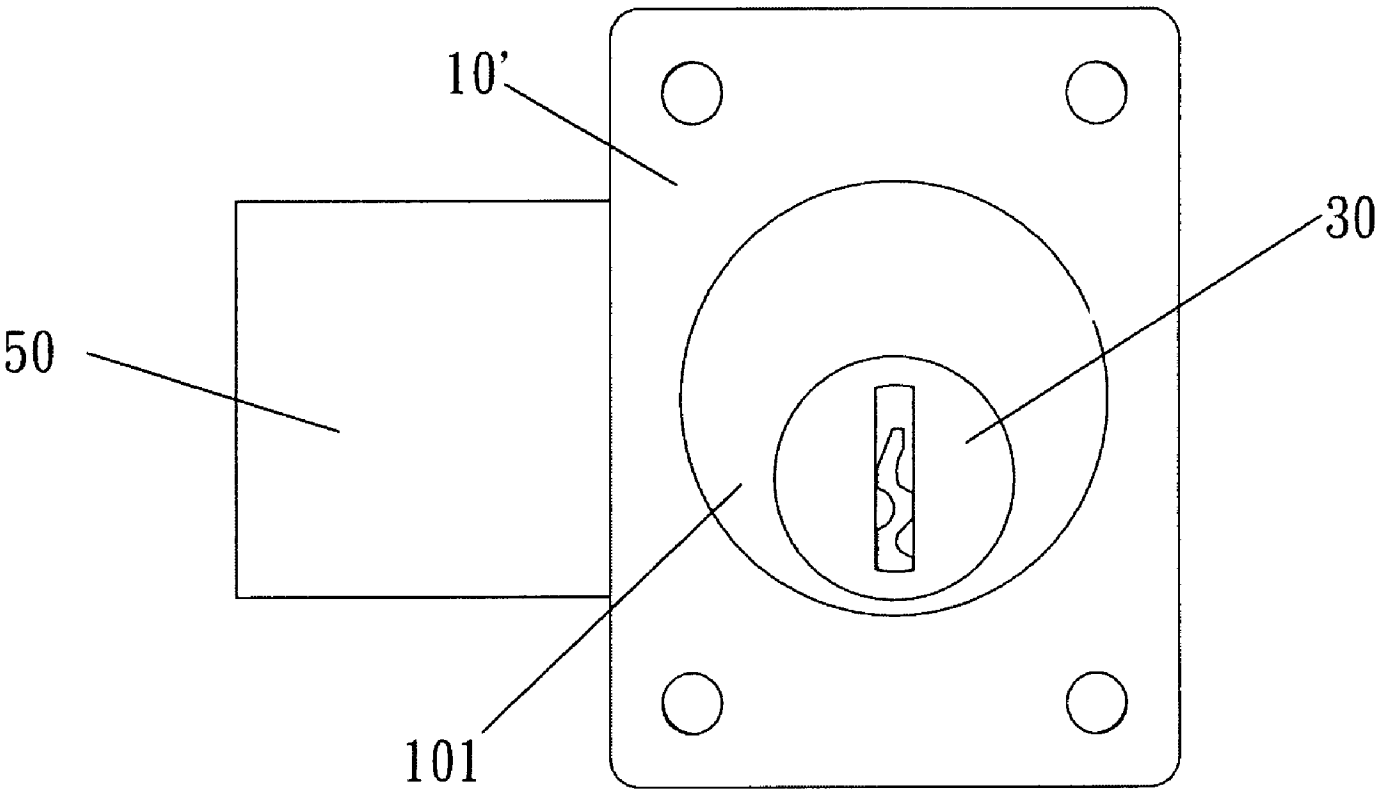
FIG. 4(PRIOR ART)
FIG. 4 shows that the dead bolt of the second conventional drawer lock set is operated in horizontal direction.
Figure 5:
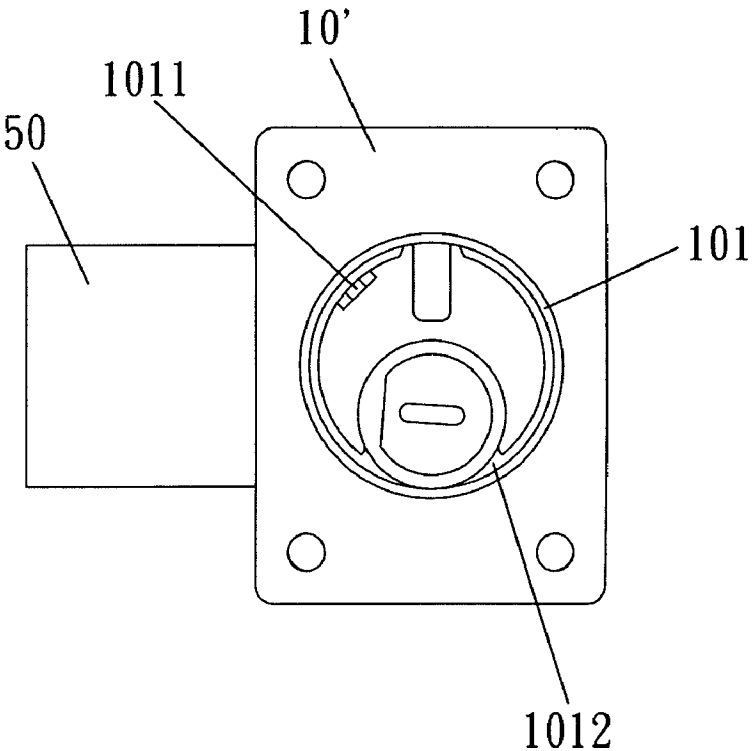
FIG. 5(PRIOR ART)
FIG. 5 shows the direction of the keyhole is changed if the operational direction of the dead bolt of the conventional drawer lock set is changed.
Figure 5:
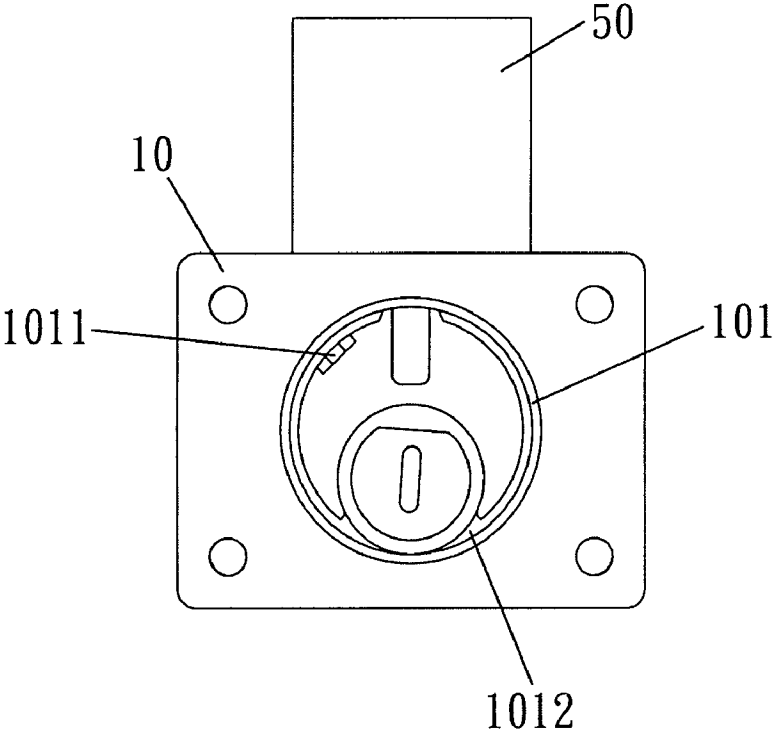
FIG. 5(PRIOR ART)
Figure 6:
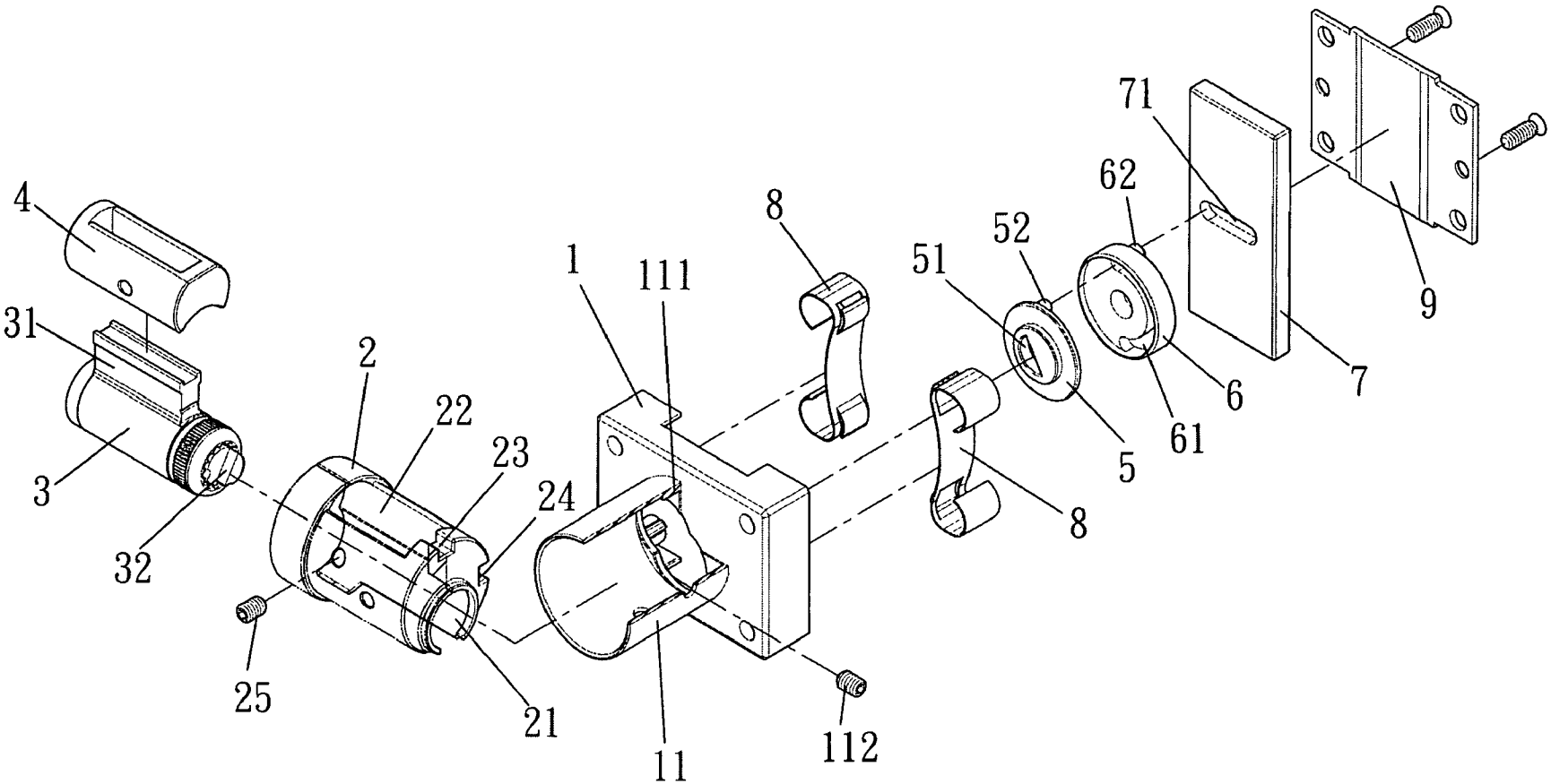
FIG. 6 is an exploded view to show the drawer lock set of the present invention.
Figure 7:
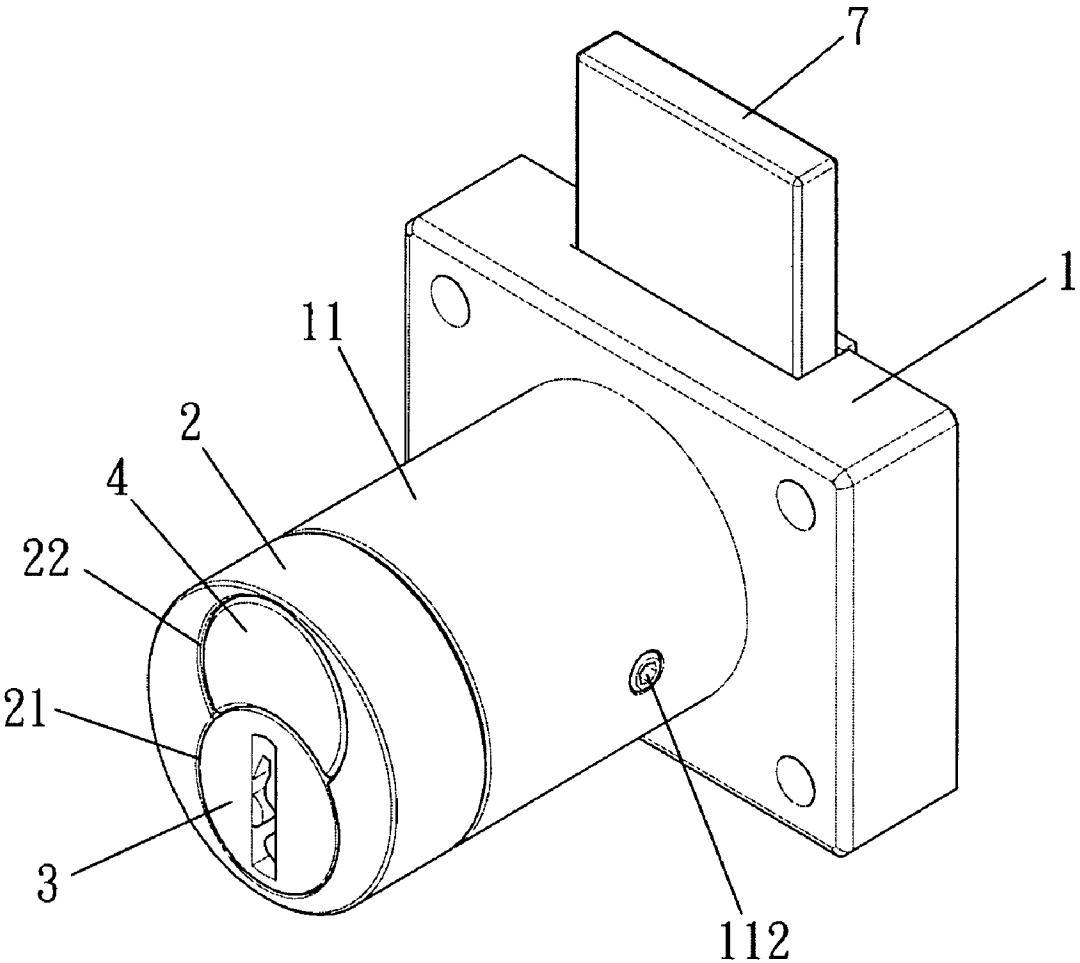
FIG. 7 is a perspective view to show the drawer lock set of the present invention.
Figure 8:
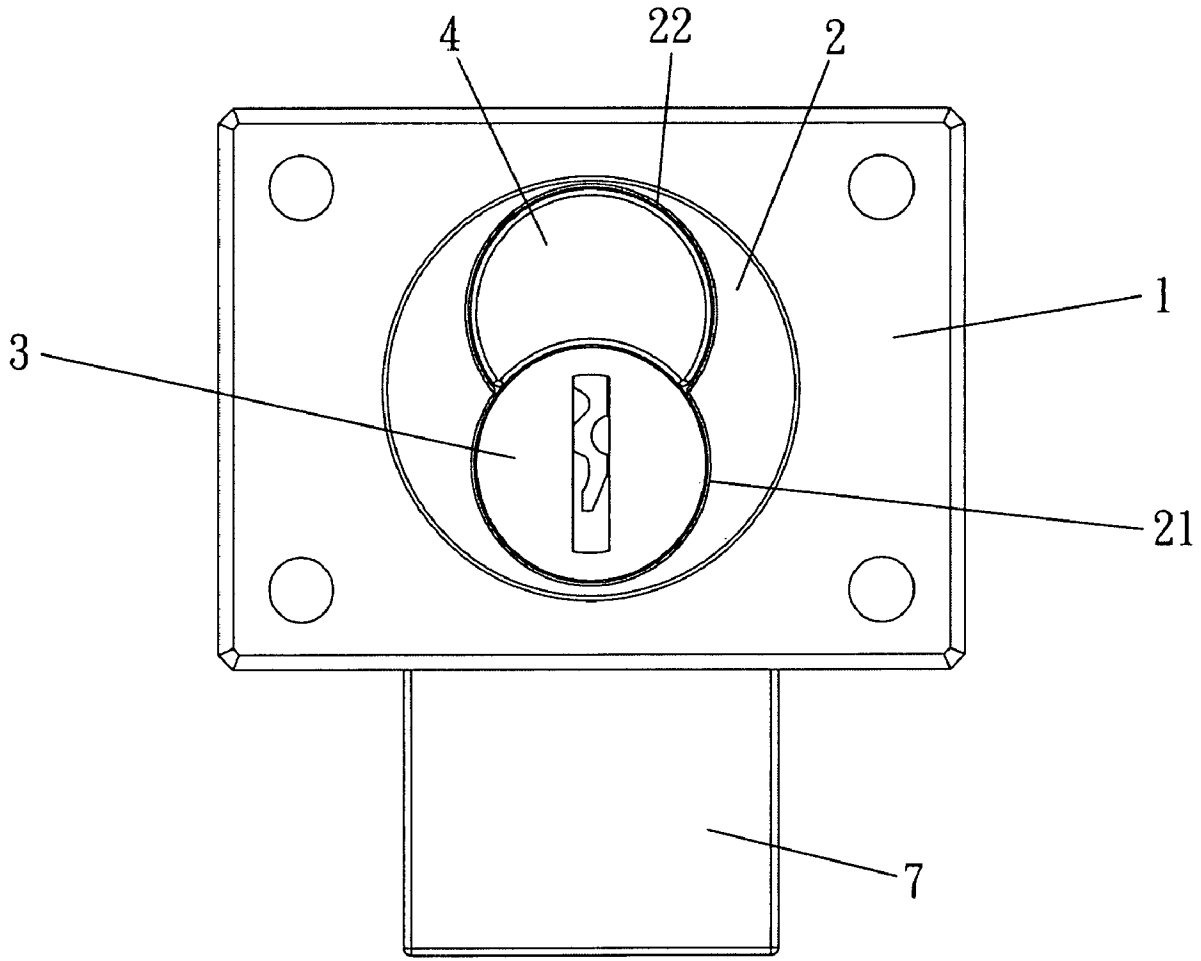
FIG. 8 shows that the dead bolt of the present invention is operated in vertical direction while the keyhole is located upright.

Referring to FIGS. 6 to 8, the drawer lock set of the present invention comprises a body 1 having a tubular member 11 extending from a first side thereof and a block 111 extends radially from an inner periphery of the tubular member 11. A cylinder 2 is received in the tubular member 11 and fixedly position within the cylinder 2 by a bolt 112 which extends through the tubular member 11 and contacts against the cylinder 2. A first notch 23 and a second notch 24 are defined in an outer periphery of the cylinder 2, a 90-degree angular distance is defined between the first and second notches 23, 24. The block 111 is engaged with one of the first and second notches 23, 24. The cylinder 2 includes a passage 21 defined therein and a reception space 22 is defined in the cylinder 2. The first and second notches 23, 24 are located corresponding to a range of an end of the reception space 22. A core 3 includes a pin frame 31 extending radially therefrom and a cap 4 is mounted to the pin frame 31. The core 3 is received in the passage 21 of the cylinder 2 and positioned by a bolt 25, and the cap 4 is located within the reception space 22. A driving piece 32 extends from a distal end of the core 3.

A transmission member 5 is connected to a second side of the body 1 and has a recess 51 in which the driving piece 32 is engaged. A first protrusion 52 extends from a side of the transmission member 5. A driving member 6 is mounted to the transmission member 5 and has a curved slot 61 defined in a first side thereof. The first protrusion 52 of the transmission member 5 is slidably engaged with the curved slot 61. A second protrusion 62 extends from a second side of the driving member 6. A dead bolt 7 is located on the second side of the driving member 6 and has a groove 71 defined therein. The second protrusion 62 is slidably engaged with the groove 71. Two pressing members 8 are located on two sides of the transmission member 5, the driving member 6 and the dead bolt 7. An end plate 9 is connected to the second side of the body 1.

When the user uses a key (not shown) to insert into the keyhole in the core 3, and rotates the key, the driving piece 32 rotates the transmission member 5 and the first protrusion 52 rotates the driving member 6, so that the second protrusion 62 slides in the groove 71 to move the dead bolt 7 to extend or retract in vertical direction.

Figure 9:
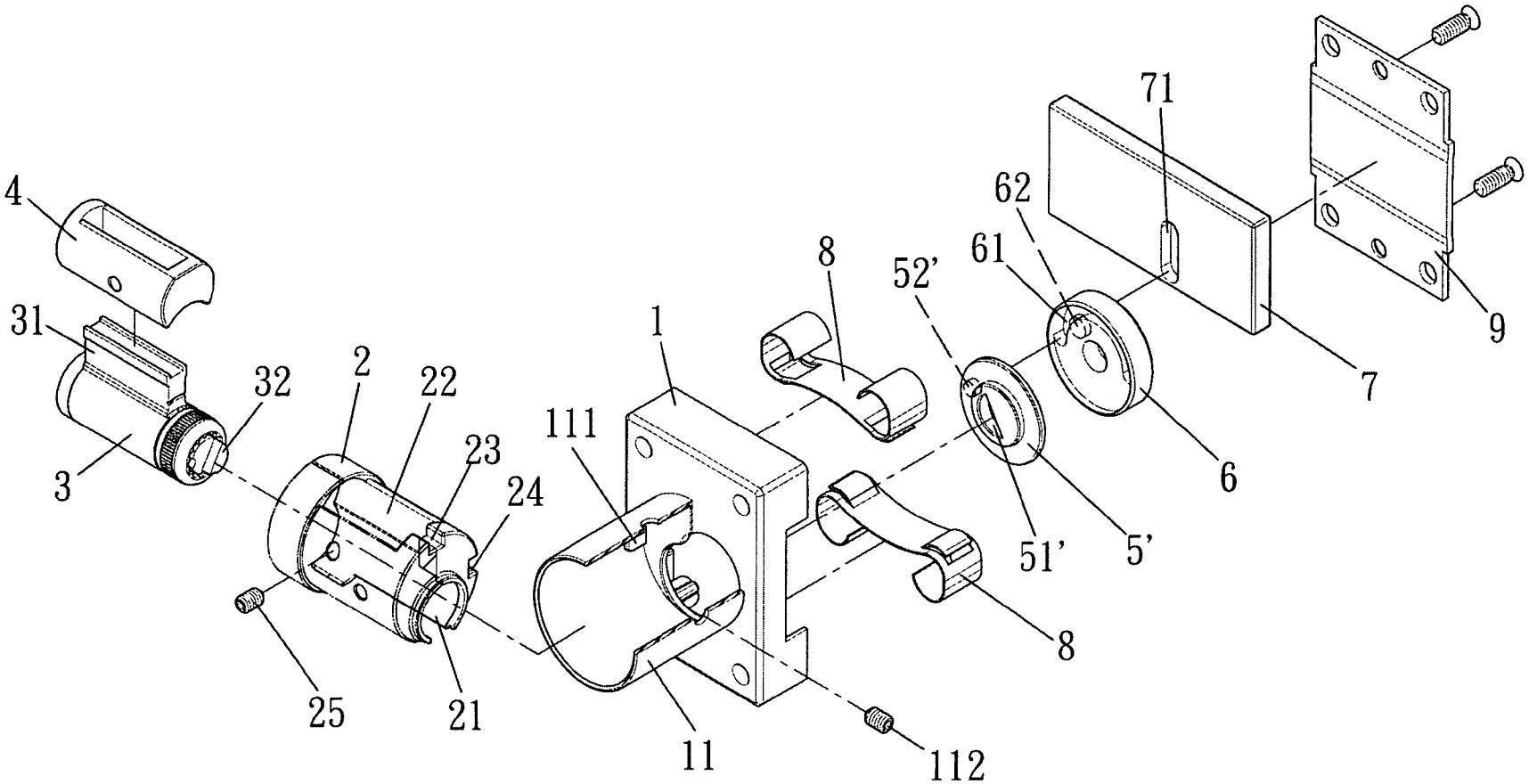
FIG. 9 is an exploded view to show that the dead bolt of the drawer lock set of the present invention is set to be operated horizontally.
Figure 10:
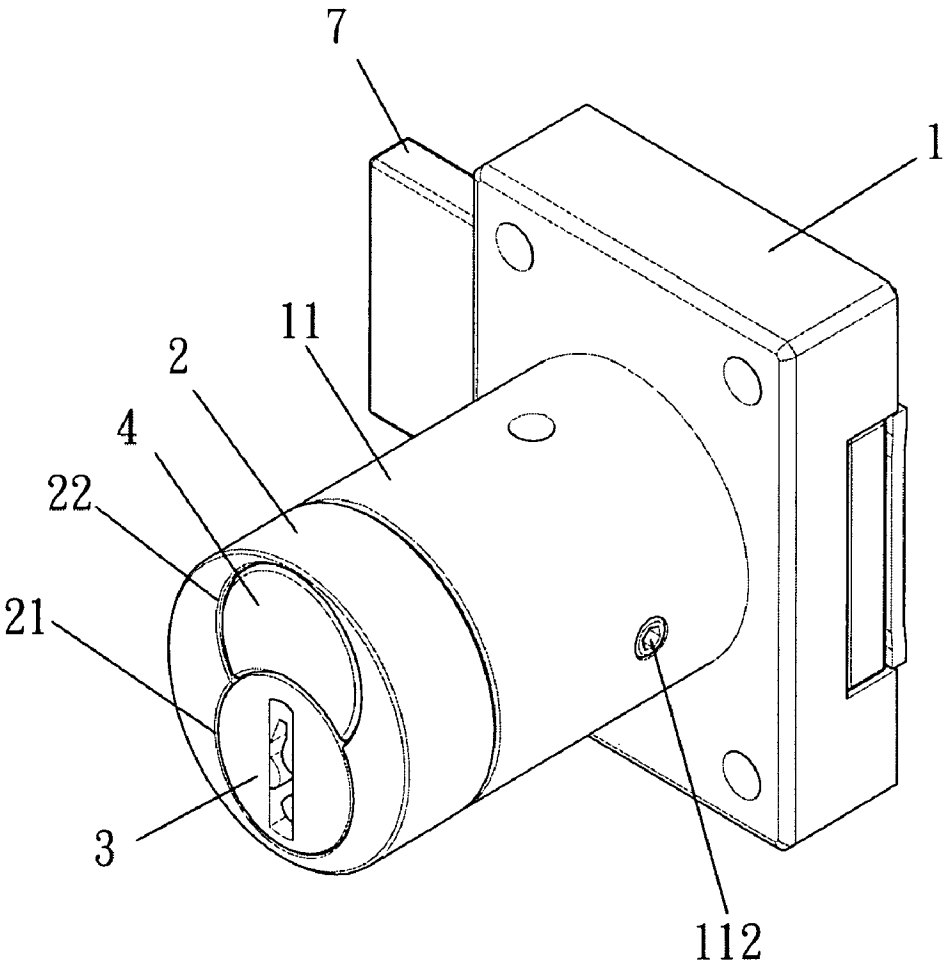
FIG. 10 is a perspective view to show the drawer lock set of the present invention in FIG. 9.
Figure 11:
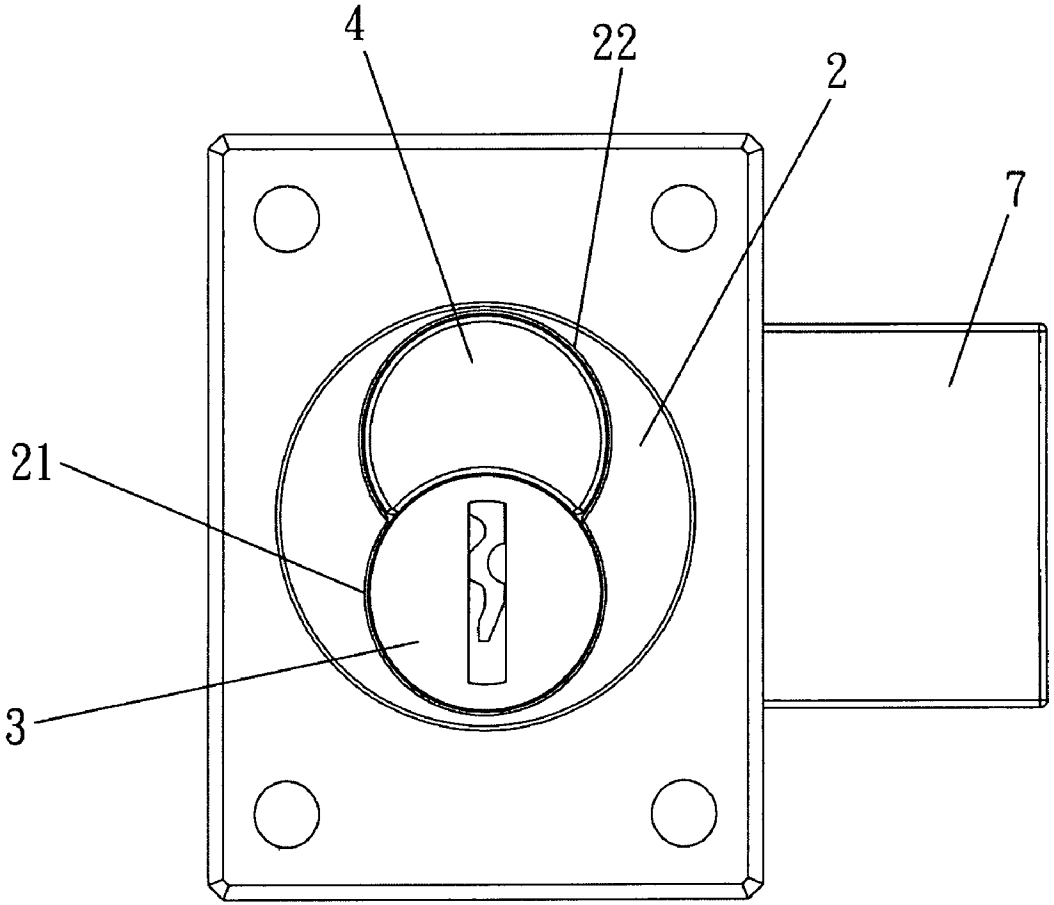
FIG. 11 shows that the dead bolt of the present invention is operated in horizontal direction while the keyhole is located upright.

If the dead bolt 7 is required to be operated in horizontal direction, as shown in FIGS. 9 to 11, the body 1 is set in the orientation as shown and the cylinder 2 is rotated an angle and the block 111 is then removed from the first notch 23 to the second notch 24. A new transmission member 5' is used which has its first protrusion 52' located at another angular position, and the driving member 6 is rotated to another angular position as shown. The dead bolt 7 is rotated 90 degrees. The driving piece 32 is engaged with the recess 51' and rotates the driving member 6 to let the second protrusion 62 to drive the horizontally orientated dead bolt 7. Therefore, the dead bolt 7 can be operated in horizontal direction.

It is noted that the cap 4 is mounted to the outside of the pin frame 31 so that different length of the pin frame 31 can be used in the drawer lock set of the present invention. In other words, the drawer lock set can be cooperated with different types of the cores 3 when needed. Furthermore, the drawer lock set requires only one cylinder 2 which can be cooperated with different types of the cores 3 and this saves the molding unit for manufacturing different cylinders. By using the cap 4, the core 3, the cap 4 and the cylinder 2 can be precisely connected to each other, the core 3 does not shake or loose during use. The drawer lock set simply replaces a new transmission member 5' and rotates the body 1, the driving member 6 and the dead bolt 7 through a 90-degree movement to transfer the drawer lock set from a vertical operation drawer lock set to horizontal operation drawer lock set.

While we have shown and described the embodiment in accordance with the present invention, it should be clear to those skilled in the art that further embodiments may be made without departing from the scope of the present invention.

What is claimed is:

1. A drawer lock set comprising:

a body having a tubular member extending from a first side thereof and a block extending radially from an inner periphery of the tubular member;

a cylinder received in the tubular member and having a first notch and a second notch defined in an outer periphery thereof, a 90-degree angular distance defined between the first and second notches, the block being engaged with one of the first and second notches;

a core received in the cylinder and having a driving piece extending from a distal end thereof, and a transmission member connected to a second side of the body and having a recess in which the driving piece is engaged, a first protrusion extending from a side of the transmission member, a driving member mounted to the transmission member and having a curved slot defined in a first side thereof, the first protrusion of the transmission member slidably engaged with the curved slot, a second protrusion extending from a second side of the driving member, a dead bolt located on the second side of the driving member and having a groove defined therein, the second protrusion slidably engaged with the groove, an end plate connected to the second side of the body.

2. The drawer lock set as claimed in claim 1, wherein the cylinder includes a passage defined therein and a reception space is defined in the cylinder, the first and second notches are located corresponding to a range of an end of the reception space, the core includes a pin frame extending radially therefrom and a cap is mounted to the pin frame, the core is received in the passage and the cap is located within the reception space.

* * * * *